US009774115B1

(12) United States Patent
Liang et al.

(10) Patent No.: US 9,774,115 B1
(45) Date of Patent: Sep. 26, 2017

(54) ELECTRICAL CONNECTOR WITH A BETTER FLATNESS OF SOLDERING TAILS

(71) Applicant: ALLTOP ELECTRONICS (SUZHOU) LTD., Taicang, JiangSu (CN)

(72) Inventors: Li-Li Liang, Taicang (CN); Yong-Gang Zhang, Taicang (CN); Feng Zheng, Taicang (CN)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/358,208

(22) Filed: Nov. 22, 2016

(30) Foreign Application Priority Data

Aug. 31, 2016 (CN) ..... 2016 1 0794332

(51) Int. Cl.

| | |
|---|---|
| ***H01R 12/00*** | (2006.01) |
| ***H01R 12/70*** | (2011.01) |
| ***H01R 12/71*** | (2011.01) |
| *H01R 107/00* | (2006.01) |

(52) U.S. Cl.
CPC ..... *H01R 12/707* (2013.01); *H01R 12/716* (2013.01); *H01R 2107/00* (2013.01)

(58) Field of Classification Search
CPC ..... H01R 12/707; H01R 24/62; H01R 12/57; H01R 13/42; H01R 13/2442; H01R 12/716; H01R 2107/00
USPC ..... 439/83
See application file for complete search history.

(56) References Cited

U.S. PATENT DOCUMENTS

| | | | | |
|---|---|---|---|---|
| 7,473,133 | B1 * | 1/2009 | Zhang | H01R 13/2442 439/607.01 |
| 8,007,327 | B2 * | 8/2011 | Yang | H01R 13/2442 439/862 |
| 2011/0130046 | A1 * | 6/2011 | Su | H01R 13/42 439/660 |
| 2012/0202384 | A1 * | 8/2012 | Liaw | H01R 12/57 439/626 |
| 2014/0308848 | A1 * | 10/2014 | Shi | H01R 24/62 439/607.55 |

* cited by examiner

*Primary Examiner* — Jean F Duverne
(74) *Attorney, Agent, or Firm* — Sughrue Mion, PLLC

(57) ABSTRACT

An electrical connector includes an insulative housing and a plurality of contacts. The insulative housing has a main portion defining a top wall, a bottom wall and a mating cavity formed between the top wall and the bottom wall, the bottom wall has a first segment, a second segment spaced apart from the first segment and a protrusion extending away from the mating cavity, the protrusion is located between the first segment and the second segment. Each contact has a retention portion, a contacting arm, an extension portion and a soldering tail, the contacts comprises a group of first contacts, a group of second contacts, a group of third contacts and a group of fourth contacts. A first insulator is molded on the extension portions of the first contacts, the first insulator defines a first positioning portion engaging with the main portion.

14 Claims, 10 Drawing Sheets

ELECTRICAL CONNECTOR WITH A BETTER FLATNESS OF SOLDERING TAILS

BACKGROUND OF THE INVENTION

1. Field of the Invention

The present invention relates to an electrical connector, and more particularly to an electrical connector having a better flatness.

2. Description of Related Art

A great variety of connectors are used for data transmission, data storage, or image display in electronic products, such as from the early general application of ATA (Advanced Technology Attachment) to SCSI (Small Computer System Interface), SATA (Serial Advanced Technology Attachment) or the more recent SAS (Serial Attached SCSI). For many emerging applications that require high speed data transmission, serial technology can solve the performance bottleneck problem of traditional parallel technology, Serial Attached SCSI (SAS) is developed from parallel SCSI based on serial technology, and except the advantages of a higher signal transmission rate, the SAS interface also can be compatible with the SATA driver and has a smaller profile than the SCSI transmission interface.

SAS connector is mainly used for high-speed serial signal transmission and power supply, and usually with an enhanced design, to achieve a higher reliability in the compact storage applications. As the SAS connector has a smaller profile, while the SAS connector having a right angle profile with a larger number of contacts, the flatness of solder tails of contacts for surface mounting to the printed circuit board is difficult to be guaranteed.

Hence, it is desired to provide an electrical connector to overcome the problems mentioned above.

BRIEF SUMMARY OF THE INVENTION

Accordingly, an object of the present invention is to provide an electrical connector having a better flatness of solder tails.

The present invention is directed to an electrical connector comprising an insulative housing and a plurality of contacts retained in the insulative housing. The insulative housing has a main portion and a mating portion extending forwardly from the main portion. The mating portion defines a top wall, a bottom wall and a mating cavity formed between the top wall and the bottom wall, the bottom wall has a first segment, a second segment spaced apart from the first segment and a protrusion extending away from the mating cavity, the protrusion is located between the first segment and the second segment. Each contact has a retention portion retaining in the main portion, a contacting arm, an extension portion and a soldering tail, and the plurality of contacts comprises a group of first contacts, a group of second contacts, a group of third contacts and a group of fourth contacts, the contacting arms of the first contacts are arranged side by side in the top wall exposed downwards in the mating cavity, the contacting arms of the second contacts and the third contacts are juxtaposed in the first segment and the second segment of the bottom wall respectively, the contacting arms of the fourth contacts are abreast in the protrusion of the bottom wall. A first insulator is molded on the extension portions of the group of first contacts, and the first insulator defines a first positioning portion engaging with the main portion of the insulative housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
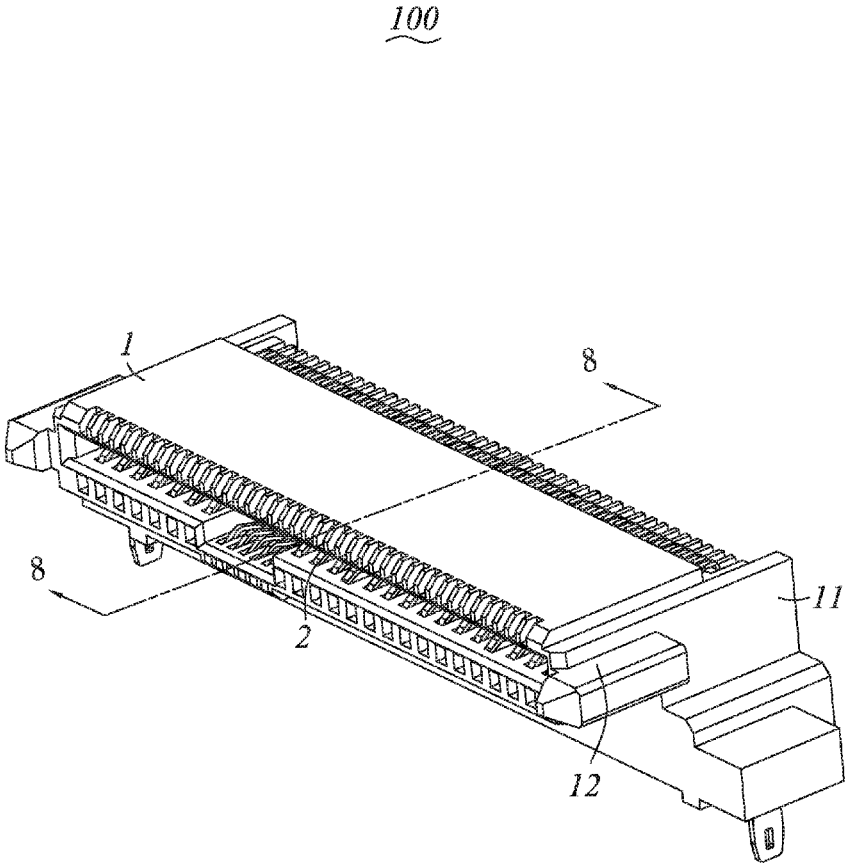
FIG. 1 is a perspective view of an electrical connector in accordance with a first illustrated embodiment of the present invention.
Figure 2:
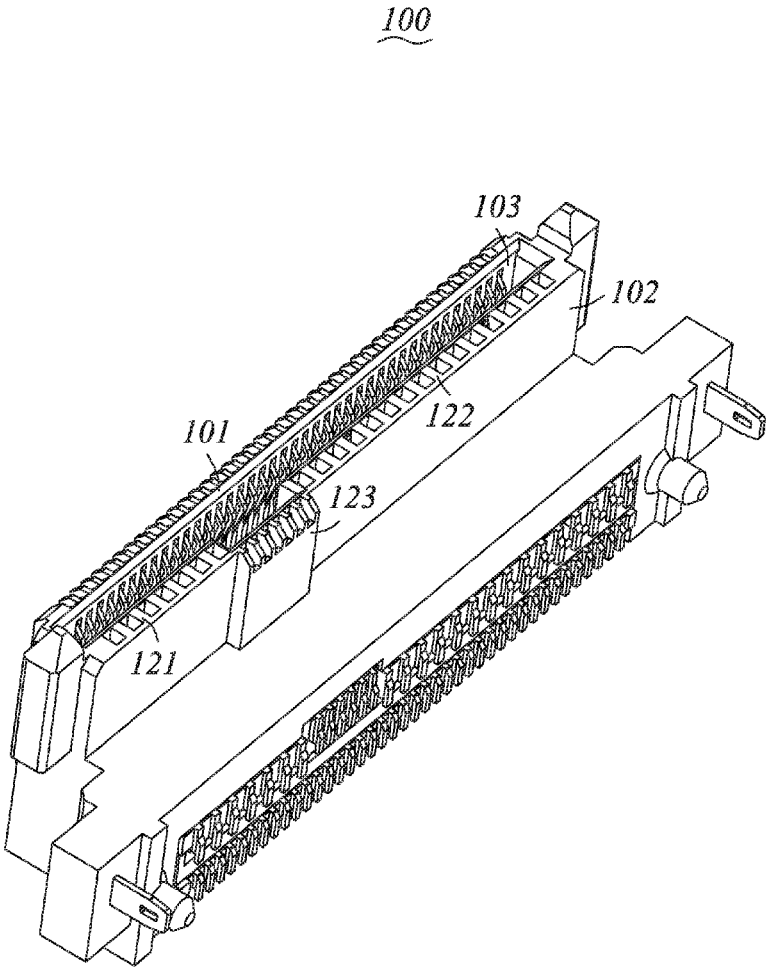
FIGS. 2-3 are similar to FIG. 1, but shown from different aspects.
Figure 3:
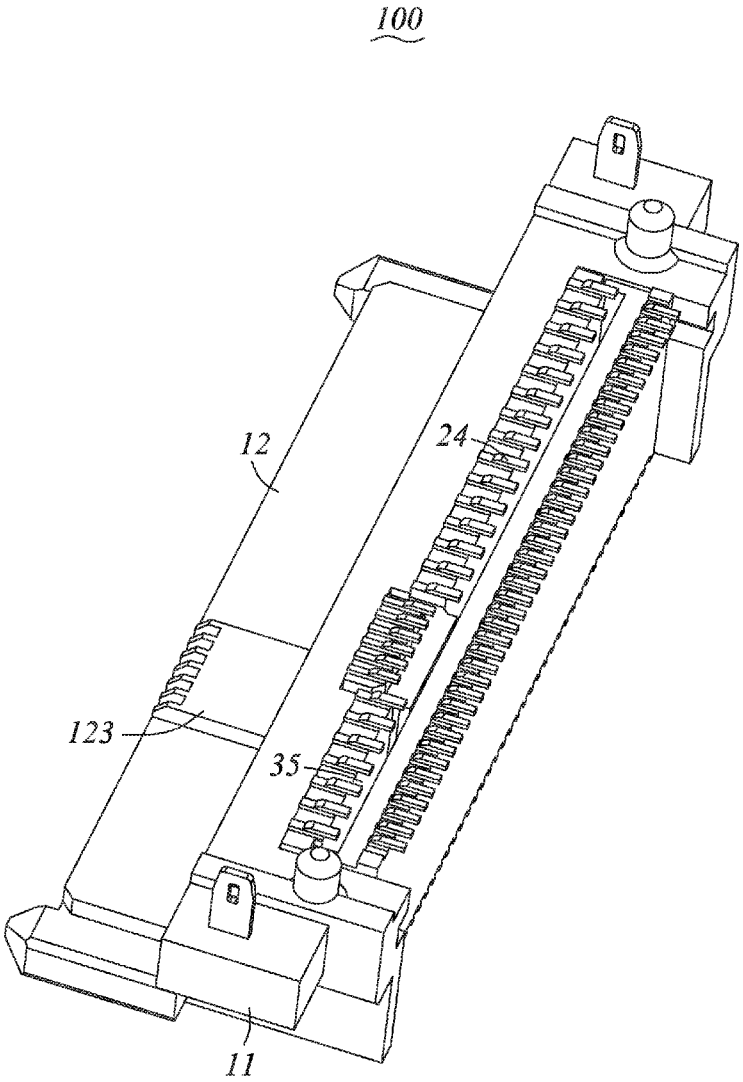
Figure 4:
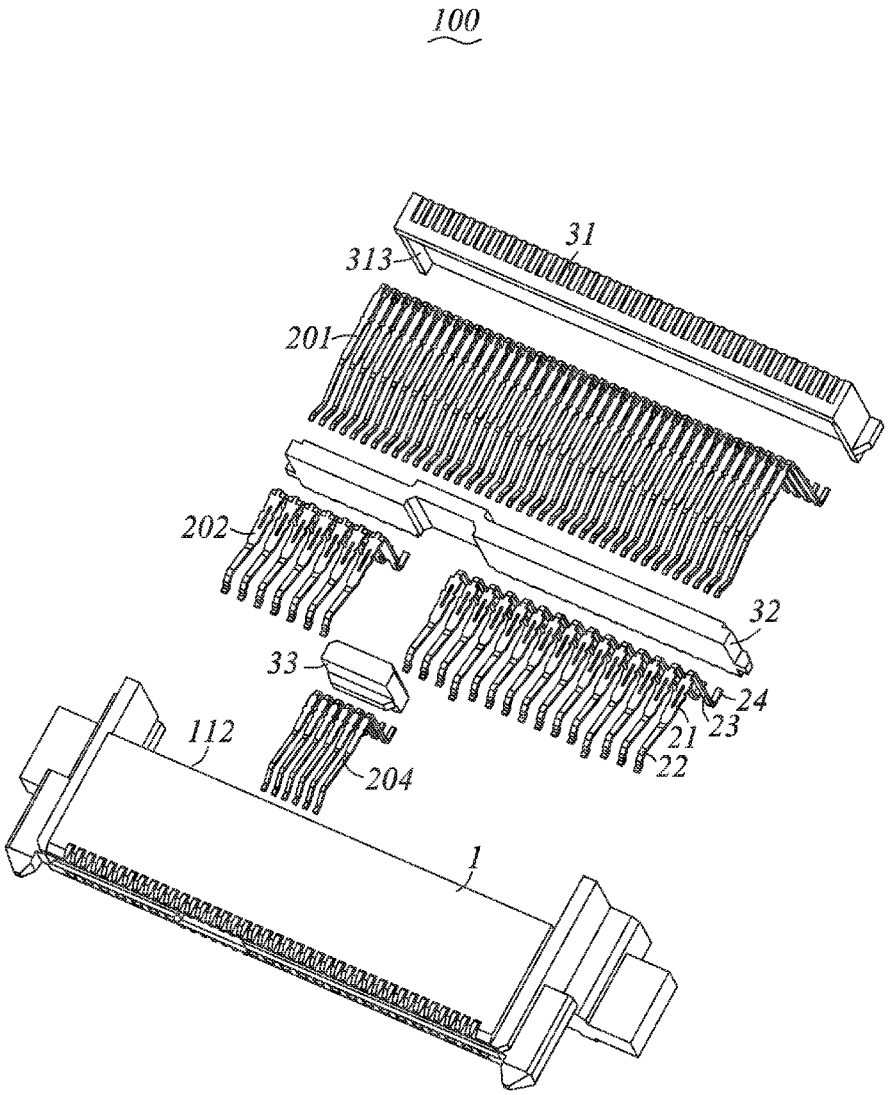
FIG. 4 is an exploded perspective view of the electrical connector shown in FIG. 1.
Figure 5:
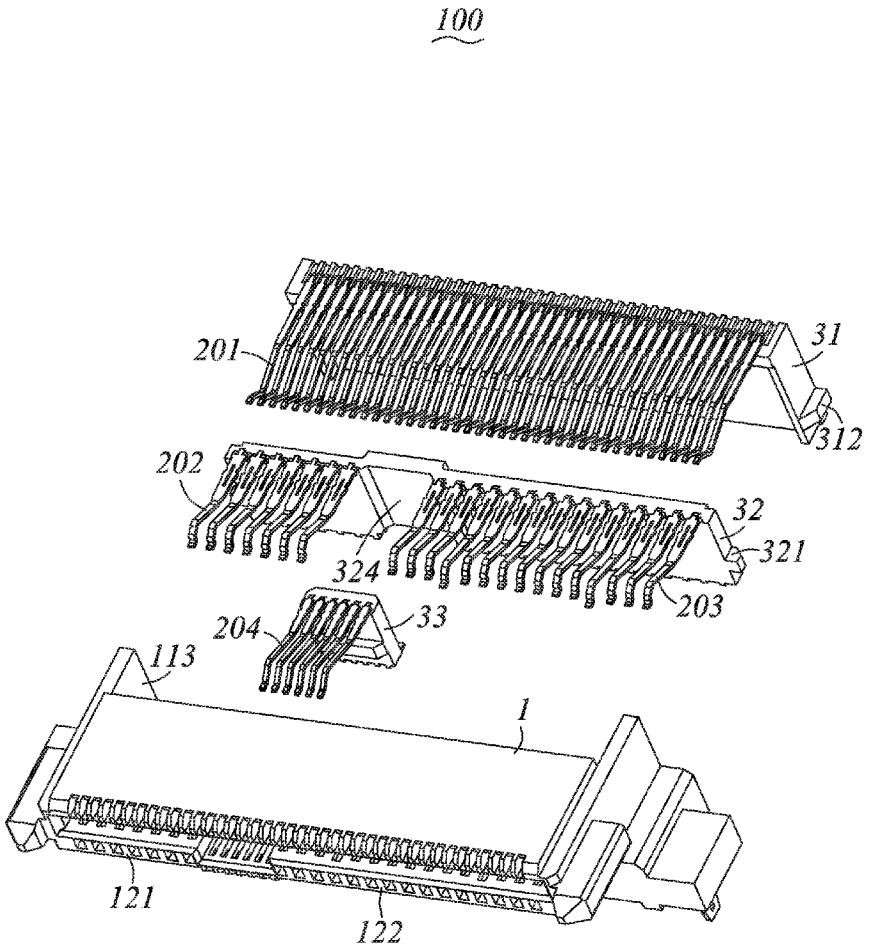
FIG. 5 is a partial assembled view of the electrical connector shown in FIG. 4.
Figure 6:
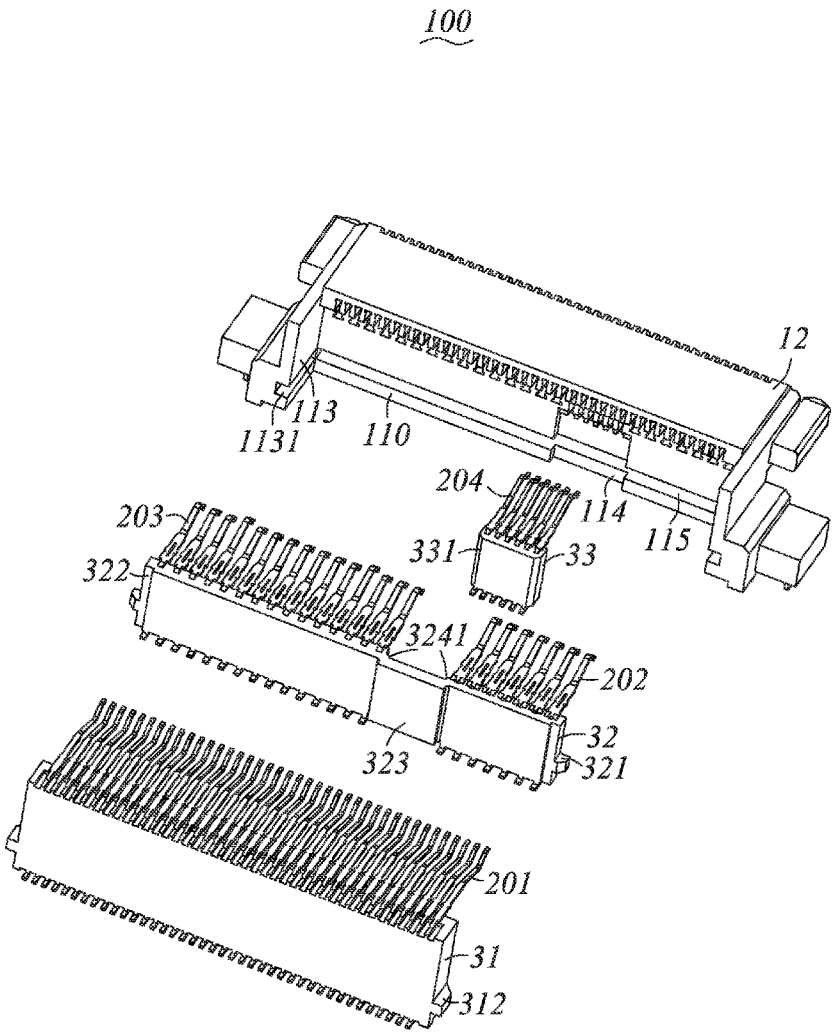
FIG. 6 is similar to FIG. 5, but viewed from a different angle.
Figure 7:
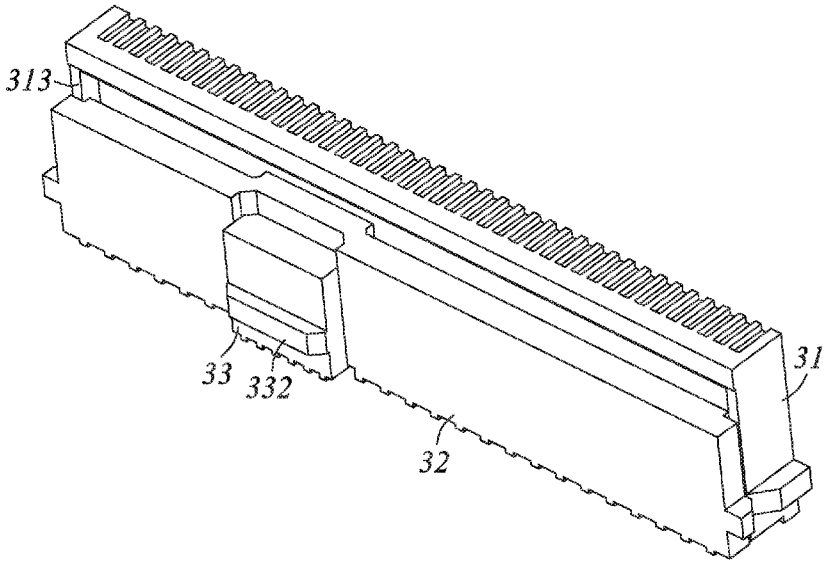
FIG. 7 is an assembled view of the electrical connector shown in FIG. 1 when an insulative housing and contacts removed away.
Figure 8:
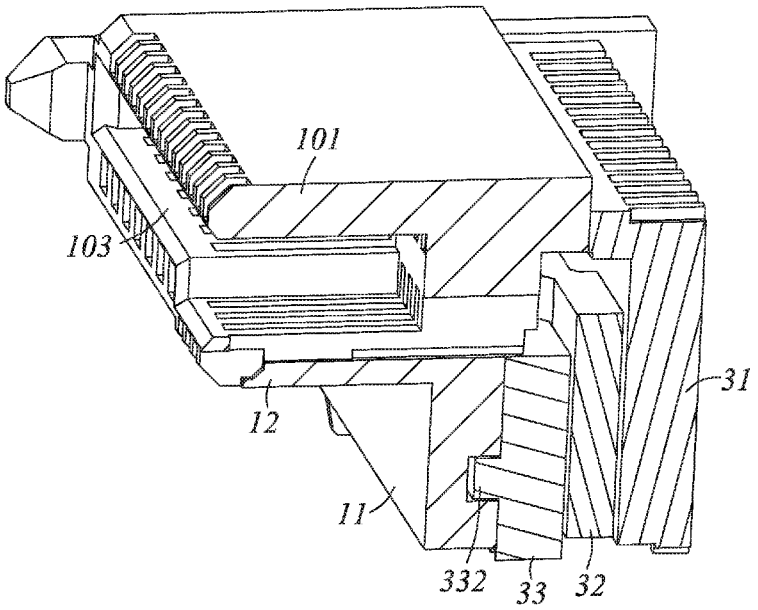
FIG. 8 is a cross-section view taken along line 8-8 of FIG. 1 when contacts removed away.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-8 illustrate a first exemplary embodiment of an electrical connector 100, and the electrical connector 100 is a SAS connector for mounting on a printed circuit board, further comprises an elongated insulative housing 1 and a plurality of contacts 2 retaining in the insulative housing 1.

Referring to FIGS. 1-6, the insulative housing 1 comprises a main portion 11 and a mating portion 12 extending forwards from the main portion 11, the mating portion 12 defines a top wall 101, a bottom wall 102 and a mating cavity 103 formed between the top wall 101 and the bottom wall 102. The bottom wall 102 has a first segment 121, a second segment 122 spaced apart from the first segment 121 and a protrusion 123 extending away from the mating cavity 103, the protrusion 123 is located between the first segment 121 and the second segment 122.

The main portion 11 defines a mounting face 110, a mounting space 112 behind the mounting face 110 and a pair of mounting walls 113 on both sides of the mounting space 112, the mounting space 112 is opening backwards. The pair of mounting walls 113 are generally parallel and opposite to each other, and each mounting wall 113 has a positioning slot 1131 extending along a front-and-back direction, the two positioning slots 1131 of the pair of mounting walls 113 are opposite to each other and communicated with the mounting space 112. The mounting space 112 is formed by the pair of mounting walls 113 connected with the mounting face 110. A receiving slot 114 and a channel 115 are recessed forwardly from the mounting face 110 of the main portion 11, and the receiving slot 114 is aligning with the protrusion 123 along the front-and-back direction. The channel 115 is elongated and extending from one mounting wall 113 to the opposite mounting wall 113 along a transverse direction. The receiving slot 114 is communicated with the channel 115, and the channel 115 has a larger depth than the receiving slot 114 along the front-and-back direction.

The plurality of contacts 2 are retained in the insulative housing 1, and each contact 2 comprises a retention portion 21 retaining in the main portion 11, a contacting arm 22 extending forwardly from one end of the retention portion 21 to the mating portion 12, an extension portion 23 bending downwardly from another end of the retention portion 21 and a soldering tail 24 bending backwardly from the extension portion 23.

The plurality of contacts 2 comprises a group of first contacts 201, a group of second contacts 202, a group of third contacts 203 and a group of fourth contacts 204. The contacting arms 22 of the first contacts 201 are arranged side by side in the top wall 101, and exposed downwards in the mating cavity 103, the contacting arms 22 of the second contacts 202 and the third contacts 203 are juxtaposed in the first segment 121 and the second segment 122 of the bottom wall 102 respectively, the contacting arms 22 of the fourth contacts 204 are abreast in the protrusion 123 of the bottom wall 102. The contacting arms 22 of the second contacts 202, the third contacts 203 and the fourth contacts 204 are exposed upwards into the mating cavity 103, and opposite to the contacting arms 22 of the first contacts 201 along a height direction of the insulative housing 1. The contacting points of the contacting arms 22 of the second contacts 202 and the third contacts 203 are located on a same height, and the contacting points of the first contacts 201 are located above that of the second contacts 202, the contacting points of the fourth contacts 204 are located below that of the second contacts 202.

Please referring to FIG. 4 to FIG. 8, the electrical connector 100 also has a first insulator 31 molded on the extension portions 23 of the group of first contacts 201. The first insulator 31 defines a first positioning portion engaging with the main portion 11 of the insulative housing 1. In present embodiment, a pair of first tabs 312 are extruding outside from both sides of the first insulator 31 and served as the first positioning portion, the first tabs 312 are sliding into and cooperated with the corresponding positioning slots 1131 of the main portion 11. A front surface of the first insulator 31 are abutting against the mounting face 110 of the insulative housing 1. The first insulator 31 defines a plurality of ribs 313 protruding forwardly from the front surface thereof, and two ribs 313 are defined on both sides of the front surface, another rib 313 is close to an upper edge of the front surface.

The electrical connector 100 also has a second insulator 32 molded on the extension portions 23 of the second contacts 202 and the third contacts 203. The second insulator 32 defines a pair of second tabs 321 on both sides thereof, and the pair of second tabs 321 are aligning with the relative first tabs 312 along the front-and-back direction. When the second insulator 32, the second contacts 202 and the third contacts 203 assembled to the insulative housing 1 together, the second insulator 32 is located in front of the first insulator 31 and coupled to insulative housing 1 by the second tabs 321 interferentially matching with the corresponding positioning slots 1131. The second insulator 32 defines a pair of indentions 322 on both side of a back surface thereof, for receiving the two ribs 313 on both side of the first insulator 31 respectively. The rib 313 on upper side of the first insulator 31 is projecting towards the second insulator 32 and located above a top surface of the second insulator 32.

The second insulator 32 also defines a bulge 323 protruding backwards, and the bulge 323 is located between the second contacts 202 and the third contacts 203 along the transverse direction. The bulge 323 is abutting against the front surface of the first insulator 31, and accommodated in a receiving space formed by the plurality of ribs 313 of the first insulator 31. A depression 324 recessed backwards from a front surface of the second insulator 32 is located between the second contacts 202 and the third contacts 203 along the transverse direction, and the depression 324 is aligning with the bulge 323 along the front-and-back direction. A pair of slant inner walls 3241 are symmetrically defined on both sides of the depression 324.

In the preferring embodiment, there is a gap 35 formed between the first insulator 31 and the second insulator 32, and the gap 35 is at least formed at an area corresponding to the soldering tails 24 of the second contacts 202 and the third contacts 203. The soldering tails 24 of the second contacts 202 and the third contacts 203 extend backwards to locate below the gap 35.

The electrical connector 100 also comprises a third insulator 33 molded on the extension portions 23 of the fourth contacts 204. The third insulator 33, the second insulator 32 and the first insulator 32 are arranged in the mounting space 112 successively along the front-and-back direction. The third insulator 33 is aligning with the depression 324 of the second insulator 32 along the front-and-back direction, and received in the depression 324 with a back section thereof. The third insulator 33 defines a pair of inclined guiding plane 331 on both sides thereof, and the guiding plane 331 is matching with the relative slant inner walls 3241 of the second insulator 32. The third insulator 33 has a bar 332 extruding forwardly from a front surface thereof, and the bar 332 is also extending along the transverse direction. A front section of the third insulator 33 is received in the receiving slot 114 of the insulative housing 1, and the bar 332 is extruding into the channel 115.

Figure 9:
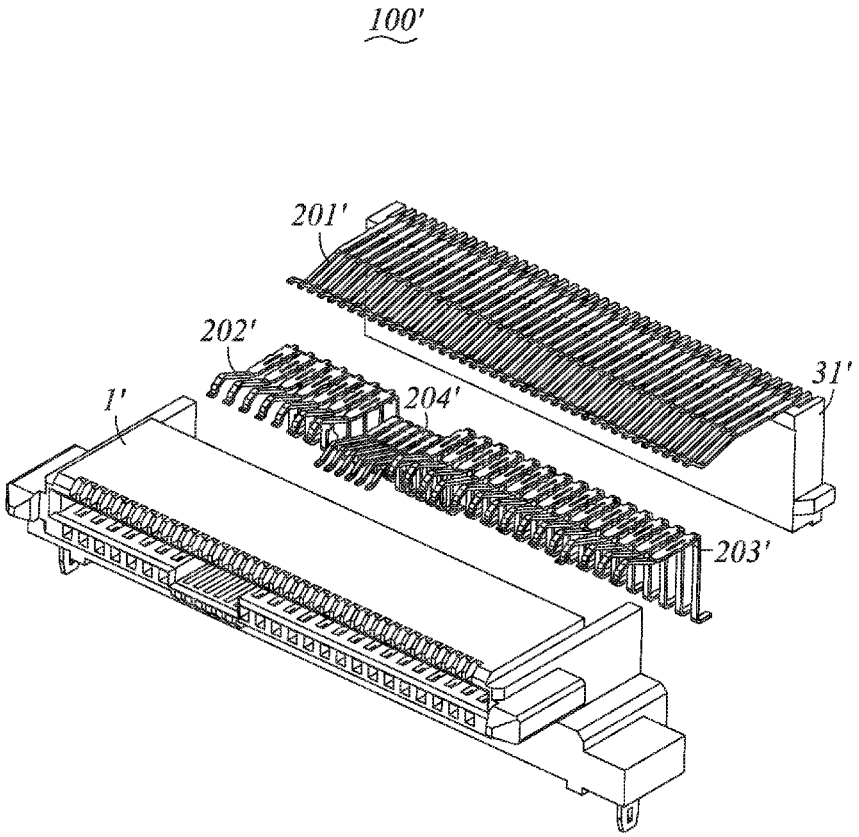
FIG. 9 is a partial exploded view of an electrical connector in accordance with a second illustrated embodiment of the present invention.
Figure 10:
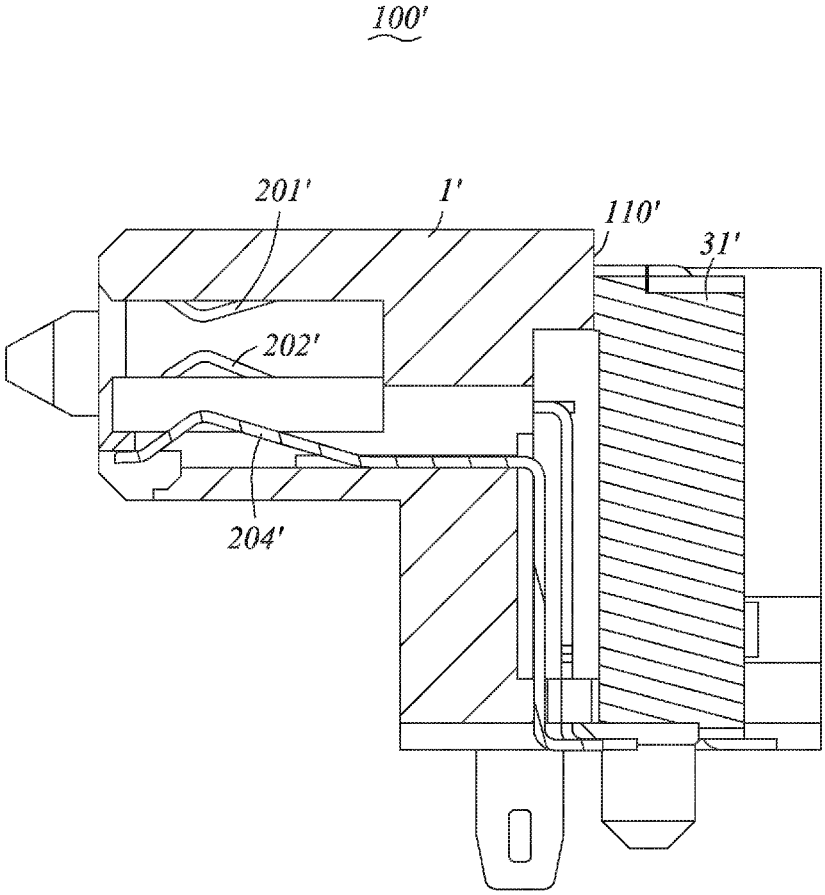
FIG. 10 is a cross-section view of the electrical connector of FIG. 9.

FIGS. 9-10 illustrate a second exemplary embodiment of an electrical connector 100', the electrical connector 100' is similar as the electrical connector 100, and there is no need to detailed describe the same structure of the electrical connector 100' here. The difference therebetween is as below: The electrical connector 100' only has a first insulator 31' molded on the extension portions 23 of the first contacts 201', and a front surface of the first insulator 31' is abutting against the mounting face 110' of the insulative housing 1'. The second contacts 202', the third contacts 203' and the fourth contacts 204' are inserted into the insulative housing 1', and extending beyond the mounting face of the insulative housing 1' for bending to form the extension portions 23 and the soldering tails 24. In other embodiments of present invention, the electrical connector 100' also can has any one of the second insulator and the third insulator while defining the first insulator 31'.

The plurality of first contacts 201 are insert molded within the first insulator 31, to ensure the flatness of soldering tails 24 of the first contacts 201. The second contacts 202 and the third contacts 203 are insert molded within the second insulator 32 together, thus guarantee the flatness of the second contacts and the third contacts simultaneously. The fourth contacts 204 are insert molded in the third insulator 33 to make each insulator combining with relative group of contacts simply.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a main portion and a mating portion extending forwardly from the main portion, the mating portion defining a top wall, a bottom wall and a mating cavity formed between the top wall and the bottom wall, the bottom wall having a first segment, a second segment spaced apart from the first segment and a protrusion extending away from the mating cavity, the protrusion located between the first segment and the second segment; and a plurality of contacts retained in the insulative housing, and each contact having a retention portion retaining in the main portion, a contacting arm extending forwardly from one end of the retention portion to the mating portion, an extension portion bending downwardly from another end of the retention portion and a soldering tail bending backwardly from the extension portion, and the plurality of contacts comprising a group of first contacts, a group of second contacts, a group of third contacts and a group of fourth contacts, the contacting arms of the first contacts arranged side by side in the top wall exposed downwards in the mating cavity, the contacting arms of the second contacts and the third contacts juxtaposed in the first segment and the second segment of the bottom wall respectively, the contacting arms of the fourth contacts abreast in the protrusion of the bottom wall; wherein a first insulator is molded on the extension portions of the group of first contacts, and the first insulator defines a first positioning portion engaging with the main portion of the insulative housing.

2. The electrical connector as claimed in claim 1, wherein the main portion defines a mounting space opening backwards and a pair of mounting walls on both sides of the mounting space, a pair of first tabs are extruding outside from both sides of the first insulator and served as the first positioning portion, and the first tabs are sliding into and cooperated with corresponding positioning slots defined on the mounting walls along a front-and-back direction.

3. The electrical connector as claimed in claim 2, wherein the electrical connector further comprises a second insulator molded on the extension portions of the second contacts and the third contacts, and the second insulator defines a pair of second tabs on both sides thereof, and the pair of second tabs are aligning with the relative first tabs along the front-and-back direction, when the second insulator, the second contacts and the third contacts assembled to the insulative housing together, the second insulator is located in front of the first insulator and coupled to insulative housing by the second tabs interferentially matching with the corresponding positioning slots.

4. The electrical connector as claimed in claim 3, wherein the first insulator at least defines two ribs protruding forwardly on both sides of a front surface thereof, and the second insulator defines a pair of indentions on both side of a back surface thereof, for receiving the two ribs of the first insulator respectively.

5. The electrical connector as claimed in claim 4, wherein the first insulator also has another rib protruding towards the second insulator and close to an upper edge of the front surface.

6. The electrical connector as claimed in claim 5, wherein the second insulator also defines a bulge protruding backwards, and the bulge is located between the second contacts and the third contacts along the transverse direction, the bulge is abutting against the front surface of the first insulator.

7. The electrical connector as claimed in claim 6, wherein the bulge is accommodated in a receiving space formed by the plurality of ribs.

8. The electrical connector as claimed in claim 7, wherein the second insulator defines a depression recessed backwards from a front surface thereof, and the depression is aligning with the bulge along the front-and-back direction.

9. The electrical connector as claimed in claim 3, wherein there is a gap formed between the first insulator and the second insulator, and the gap is at least formed at an area corresponding to the soldering tails of the second contacts and the third contacts, the soldering tails of the second contacts and the third contacts extend backwards to locate below the gap.

10. The electrical connector as claimed in claim 3, wherein a depression is recessed backwards from a front surface of the second insulator and located between the second contacts and the third contacts along the transverse direction, a third insulator is molded on the extension portions of the fourth contacts and received in the depression with a back section thereof.

11. The electrical connector as claimed in claim 10, wherein a pair of slant inner walls are symmetrically defined on both sides of the depression, the third insulator defines a pair of inclined guiding plane on both sides thereof, and the guiding plane is matching with the relative slant inner walls.

12. The electrical connector as claimed in claim 10, wherein the third insulator, the second insulator and the first insulator are arranged in the mounting space successively along the front-and-back direction.

13. The electrical connector as claimed in claim 1, further comprising a third insulator molded on the extension portions of the fourth contacts, and the third insulator is arranged in front of the first insulator.

14. The electrical connector as claimed in claim 1, wherein the contacting arms of the second contacts, the third contacts and the fourth contacts are exposed upwards into the mating cavity, and opposite to the contacting arms of the first contacts along a height direction of the insulative housing.

* * * * *